US005884809A

United States Patent [19]

Wood et al.

[11] Patent Number: 5,884,809

[45] Date of Patent: Mar. 23, 1999

[54] AIR SEPARATING FUEL DISPENSING SYSTEM

[75] Inventors: Gregory P. Wood, Kentwood; Michael D. Walters, Hudsonville; Scott M. Olson, Grand Rapids, all of Mich.

[73] Assignee: Delaware Capital Formation, Inc., Wilmington, Del.

[21] Appl. No.: 841,796

[22] Filed: May 5, 1997

[51] Int. Cl.[6] ..... B67D 5/58

[52] U.S. Cl. ..... 222/72; 55/204; 222/318; 416/101; 417/310

[58] Field of Search ..... 222/72, 318; 55/201–206; 416/101; 417/310; 418/47

[56] References Cited

U.S. PATENT DOCUMENTS

| | | | |
|---|---|---|---|
| 1,868,444 | 7/1932 | Bechtold | 222/72 X |
| 2,164,441 | 7/1939 | Bechtold | 222/72 |
| 2,330,634 | 9/1943 | Shoemaker | 417/310 X |
| 2,330,703 | 9/1943 | Grise | 417/310 X |
| 2,351,331 | 6/1944 | Goldberg | 222/72 |
| 2,693,196 | 11/1954 | Hundley . | |
| 2,779,503 | 1/1957 | Wright et al. | 222/72 |
| 2,967,005 | 1/1961 | Kramer | 222/72 X |
| 3,147,884 | 9/1964 | Sacco | 222/318 X |
| 3,159,310 | 12/1964 | Rafferty | 222/72 X |
| 3,266,425 | 8/1966 | Brunson | 222/72 |
| 3,715,863 | 2/1973 | Zanoni | 55/204 |
| 3,734,124 | 5/1973 | Zanoni et la. . | |
| 3,802,570 | 4/1974 | Dehne . | |
| 4,222,751 | 9/1980 | Shunta | 55/204 |
| 4,358,299 | 11/1982 | Jensen et al. | 55/204 |
| 4,394,138 | 7/1983 | Schilling . | |
| 4,447,189 | 5/1984 | Jensen et al. | 55/204 X |
| 4,775,292 | 10/1988 | Jensen et al. | 55/204 X |
| 4,806,135 | 2/1989 | Siposs | 55/204 |
| 4,978,374 | 12/1990 | Janssen et al. . | |
| 5,051,072 | 9/1991 | Yano et al. . | |
| 5,064,452 | 11/1991 | Yano et al. . | |
| 5,085,561 | 2/1992 | Yano et al. . | |
| 5,363,988 | 11/1994 | Saxton et al. | 222/72 |
| 5,571,003 | 11/1996 | Tuckey . | |

FOREIGN PATENT DOCUMENTS

| | | |
|---|---|---|
| 0 473 818A1 | 3/1992 | European Pat. Off. . |
| 0 532 202A2 | 3/1993 | European Pat. Off. . |
| 0 556 527A1 | 8/1993 | European Pat. Off. . |
| 0 691 304A1 | 1/1996 | European Pat. Off. . |

*Primary Examiner*—Kevin P. Shaver
*Attorney, Agent, or Firm*—Flynn, Thiel, Boutell & Tanis, P.C.

[57] ABSTRACT

A dispensing system (20) for drawing fuel from a storage tank (22) to a nozzle (44). The system includes an above-tank suction pump (26) which draws fuel from the tank. The fuel is discharged from the suction pump into a vertically aligned air separator (38) so as to produce a fuel stream that is substantially free of air. The fuel stream is discharged from the air separator to a flow meter (30) and the nozzle through a fuel shutoff valve (46). The open/closed state of the fuel shutoff valve is controlled by a control actuator (48) based on the differential processor across the air separator. Should this differential pressure drop below a given level, the fuel shutoff valve is closed to prevent the system from inadvertently supply a fuel stream with an unacceptably high air content. Gaseous fluid removed by the air separator is supplied to an air eliminator (40). The fuel components of this fluid stream are removed in the air eliminator and returned to the suction pump.

33 Claims, 10 Drawing Sheets

AIR SEPARATING FUEL DISPENSING SYSTEM

FIELD OF THE INVENTION

This invention relates generally to dispensing systems employed to deliver liquid-state fuel and, more particularly, to a dispensing system designed to remove air that may be contained in the fuel stream.

BACKGROUND OF THE INVENTION

A dispensing system is the assembly at a gasoline station that actually delivers the fuel, (e.g. gasoline, diesel fuel, kerosene or alcohol) from a storage tank into the tank of the vehicle in which the fuel is to be used. At most gasoline stations and other locations at which the fuel is dispensed, the fuel is stored in an underground storage tank. The dispensing system includes a pump that draws the fuel from the storage tank to an above ground level elevation so that it will flow into the vehicle fuel tank. In a typical dispensing system, the fuel is pumped from the storage tank, passed through a flow meter and then is delivered to the vehicle through a flexible hose. The flow meter performs a volumetric measurement of the quantity of the fuel that is discharged to provide the data needed to ensure that the customer is accurately charged for the amount of fuel delivered. Often this charge data is presented on a display associated with a data processing unit that also forms part of the dispensing system.

In the past it has been a common practice to design a fuel dispensing system so that it includes a submersible pump that is located in the base of the associated storage tank. When the pump is actuated, it forces the fuel from the tank through a supply line that leads to an above-ground dispenser and from there through a hose through which it is delivered to the vehicle. A disadvantage of this dispensing system is that should there be any leaks in the supply line to the dispenser, the fuel, which is under pressure, is prone to flow out of the tank wherein it can potentially serve as an environmental pollutant.

One solution to this problem is to provide a dispensing system with a suction pump. This type of system is designed so that the pump is located in the actual above ground housing in which most of the other components of the system, the flow meter, the processor and the hose connection, are contained. The pump develops a suction which draws the fuel from the storage tank and then forces the fuel from the pump and through the flow meter and the hose. An advantage of providing a dispensing system with a suction pump is that should there be any leaks in the supply line, the suction drawn by the pump, instead of allowing the fuel to flow out, will draw air into the line. Thus, these type of dispensing systems serve to minimize the unwanted fuel leakage and the attendant enviromental damage such leakage can foster.

While a dispensing system with a suction pump is useful for reducing the likelihood of environmental damage, there is a disadvantage associated with its use. Should a leak be present in the associated supply line, the air drawn into the line by the pump will be compressed in the pump and entrained into the fuel stream that flows through the flow meter and out through the hose. The air is then delivered to the vehicle along with the liquid-state fuel. Consumers, who pay for fuel based on volumetric quantity delivered, take exception to finding they have paid for fuel and have, instead, received a sizeable quantity of air. In many jurisdictions regulatory authorities have placed strict limits on the error rate between the quantity of liquid-state fuel that is measured by the flow meter and the actual amount of fuel actually delivered.

Thus, a typical dispensing system with a suction-type pump is further provided with some type of air separation unit. One such air separation has an elongated, horizontally aligned chamber that is located downstream of the pump. The fuel is introduced in this chamber so as to form a horizontally oriented vortex. Air disposed within the fuel stream as it enters the chamber is supposed to migrate to the center of the chamber where it is forced out through an appropriate duct. While this air separator is of some utility, its overall ability to remove air from the fuel stream in certain situations is open to question.

Moreover, it is further desirable to provide this type of system for monitoring the quantity of air in the fuel stream prior to the fuel stream being applied to the flow meter. This monitoring is desirable because, in the event the quantity of the air is above a given level, the air separator, regardless of its efficiency, may not be able to remove sufficient quantities of air from the fuel stream. When the fuel stream is in this state, the dispensing system should shut down as opposed to continue to operate while possibly delivering inaccurately metered volumes of fuel. In the known prior art system, this monitoring is performed by simply monitoring the pressure of the fuel stream at a point downstream from the air separator and upstream of outlet of the dispensing system. If the fuel stream at this point contains a significant quantity of air, the pressure head at this point should fall. This pressure drop is then interpreted as an indication that the fuel stream contains such a large quantity of air that downstream delivery of the fuel should cease. A potential problem with this type of monitoring system is that the pressure head being monitored may change as a function of flow rates downstream of the point at which the monitoring occurs. In some circumstances, these variations could potentially result in a pressure head developing that does not accurately represent the quantity of air in the fuel stream. Thus a potential exists that the pressure head being monitored will indicate that there is only a minimal amount of air in the fuel stream when, in fact, that is not the case. If this occurs, the dispensing system will continue to allow fuel to be dispensed even though the fuel stream may contain an unacceptably high quantity of air.

SUMMARY OF THE INVENTION

This invention relates to an improved dispensing system with an air separator that, during normal operation, removes air from the fuel stream before the fuel is applied to the flow meter and that, during abnormal operating states, prevents the dispensing of any fuel. This invention further relates to an improved dispensing system with a pump designed to provide relatively high volumes of fuel and that is relatively compact in size.

BRIEF DESCRIPTION OF THE DRAWINGS

The invention is pointed out with particularity in the appended claims. The above and further features of this invention may be better understood by reference to the following description taken in conjunction with the accompanying drawings, in which:

SUMMARY OF THE INVENTION

Figure 1:
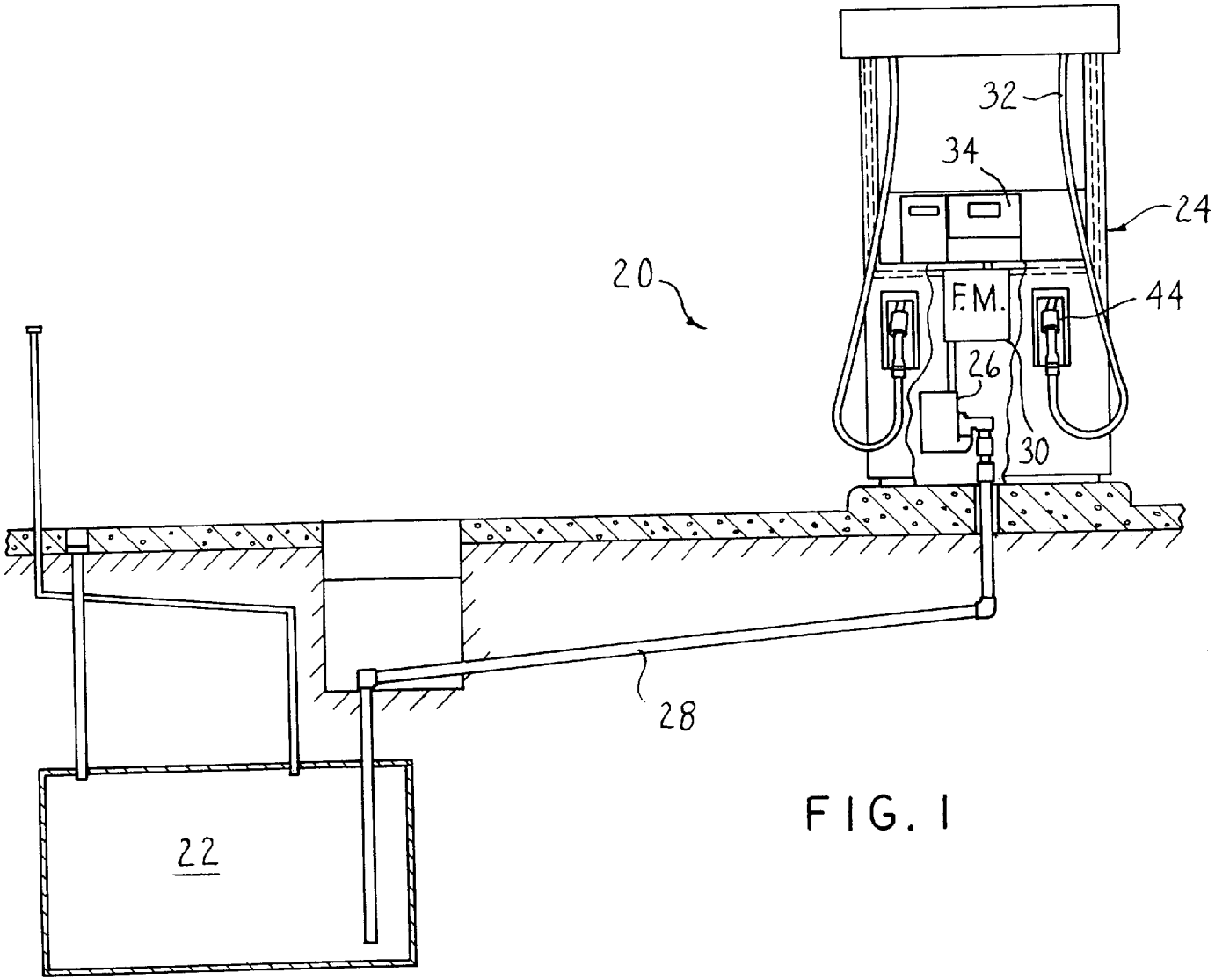
FIG. 1 is a diagrammatic illustration of the environment in which the dispensing system of this invention is employed.

FIG. 1 depicts how the dispensing system 20 of this invention is employed to facilitate the delivery of liquid-state fuel to a vehicle. The fuel is contained in an underground storage tank 22. The dispensing system 20 is contained in an above ground dispenser unit 24. Integral with the dispensing system is 20 a suction pump 26. Fuel is drawn from the storage tank 22 into the pump 26 through a supply line 28. The fuel is then discharged from the pump into a flow meter 30 and then through a flexible hose 32 for delivery into the vehicle. The flow meter 30 provides a volumetric measure of the quantity of the fuel that is delivered to the vehicle. Data signals representative of this volumetric measure are supplied by the flow meter 30 to a processing unit 34. The processing unit 34 both displays an indication of the quantity of the fuel delivered and an indication of the charge to the customer.

Figure 2:
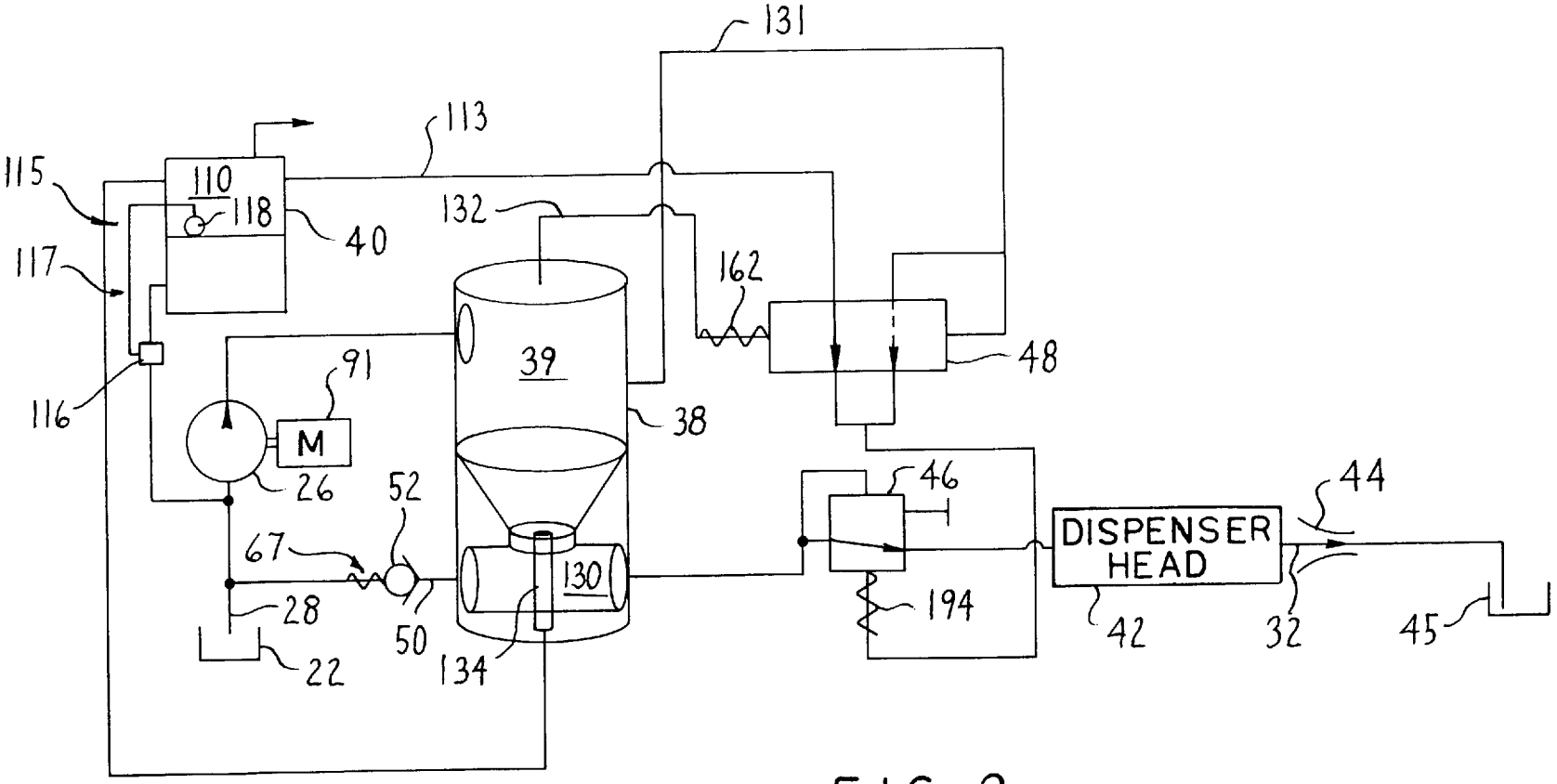
FIG. 2 is a block diagram illustrating the primary components of the dispensing system of this invention.

The basic components of the dispensing system 20 are depicted in the block diagram of FIG. 2. The pump 26 has an inlet through which fuel is drawn from the storage tank 22. The fuel is discharged from the pump 26 through an outlet into a centrifugal air separator 38. As will be described in more detail hereinafter, air separator 38 is formed to have an air separation chamber 39. The fuel stream is introduced into the air separation chamber 39 in a in cyclonic flow pattern so that air entrained in the liquid fuel stream is forced to the center of the chamber. The air, as well as any volatilized fuel contained therein, flows from the air separation chamber 39 to an air eliminator 40. Air eliminator 40 has a chamber 110 which allows fuel droplets to settle to the bottom thereof. The collected fuel droplets are returned to the inlet of pump 26.

The air-free, liquid-state fuel stream produced by the air separator 38 is applied to a dispenser head 42. The dispenser head 42 includes a number of the components found in a conventional dispensing system namely, the flow meter 30 and an on/off valve. The fuel flows from the dispenser head 42 through the flexible hose 32. The discharge of fuel from the flexible hose 32 into the tank 45 of a vehicle is controlled by a nozzle 44 at the end of the hose. In some versions of the invention, hose 32 and nozzle 44 may have a return line that facilitates the recovery of vapor that is discharged from the vehicle tank 45.

During normal operation of the dispensing system 20, air separator 38 removes the air entrained into the fuel stream down to levels acceptable by regulatory authorities. However, in the event there is a significant leak in the dispensing system 20 or any of the upstream components, a large amount of air may become entrained in the fuel stream upstream of the pump 26. If this occurs, the air separator 38 may not be able to remove the air down to acceptable levels. Fuel flow from the air separator 38 to the dispenser head 42 is thus regulated by a fuel shutoff valve 46.

The open/closed state of the fuel shutoff valve 46 is set by a control actuator 48. Control actuator 48 monitors the pressure difference between the pressure present at the center of the air separation chamber 39 and the pressure present at the outer perimeter of the air separation chamber. The pressure around the outer perimeter of the air separation chamber 39 is higher than the pressure in the center of the chamber; the difference is pressure is proportional to the quantity of air in the fuel stream introduced into the air separator 38. As long as the difference in pressure between in the center and outer perimeter of the air separation chamber 39 is relatively high, control actuator 48 applies a fluid column with an ambient air pressure head to fuel shutoff valve 46. The pressure head of the fuel stream discharged from air separator 38 provides enough force to hold fuel shutoff valve 46 in the open state so as to allow normal operation of the dispenser system 20.

However, if a large amount of air suddenly becomes entrained in the fuel stream discharged from the pump 26, the differential pressure across the air separation chamber 39 will drop. Should this drop occur, control actuator 48 switches states and applies a fluid column with a relatively high pressure head to the fuel shutoff valve 46. The force generated by this fluid column causes fuel shutoff valve 46 to close so as to block fuel flow to the dispenser head 42. This stoppage of fuel flow thus prevents a fuel stream with a potentially significant amount of entrained air from being delivered by the dispensing system 20.

It will further be observed that there is a fluid conduit 50 that extends from the air separator 38 back to the inlet side of the pump 26. Fuel flow through this line is regulated by a normally closed bypass valve 52. In the event fuel discharged out of the dispenser head 42 is stopped for any reason while the pump 26 is actuated or if the back pressure from dispenser head 42 is relatively high, the pressure head of the fuel discharged from the air separator 38 supplies enough force to urge bypass valve 52 into the open state. Thus, fuel discharged from pump 26 when the dispensing system 20 is in this state is returned back to the inlet end of the pump.

Figure 3:
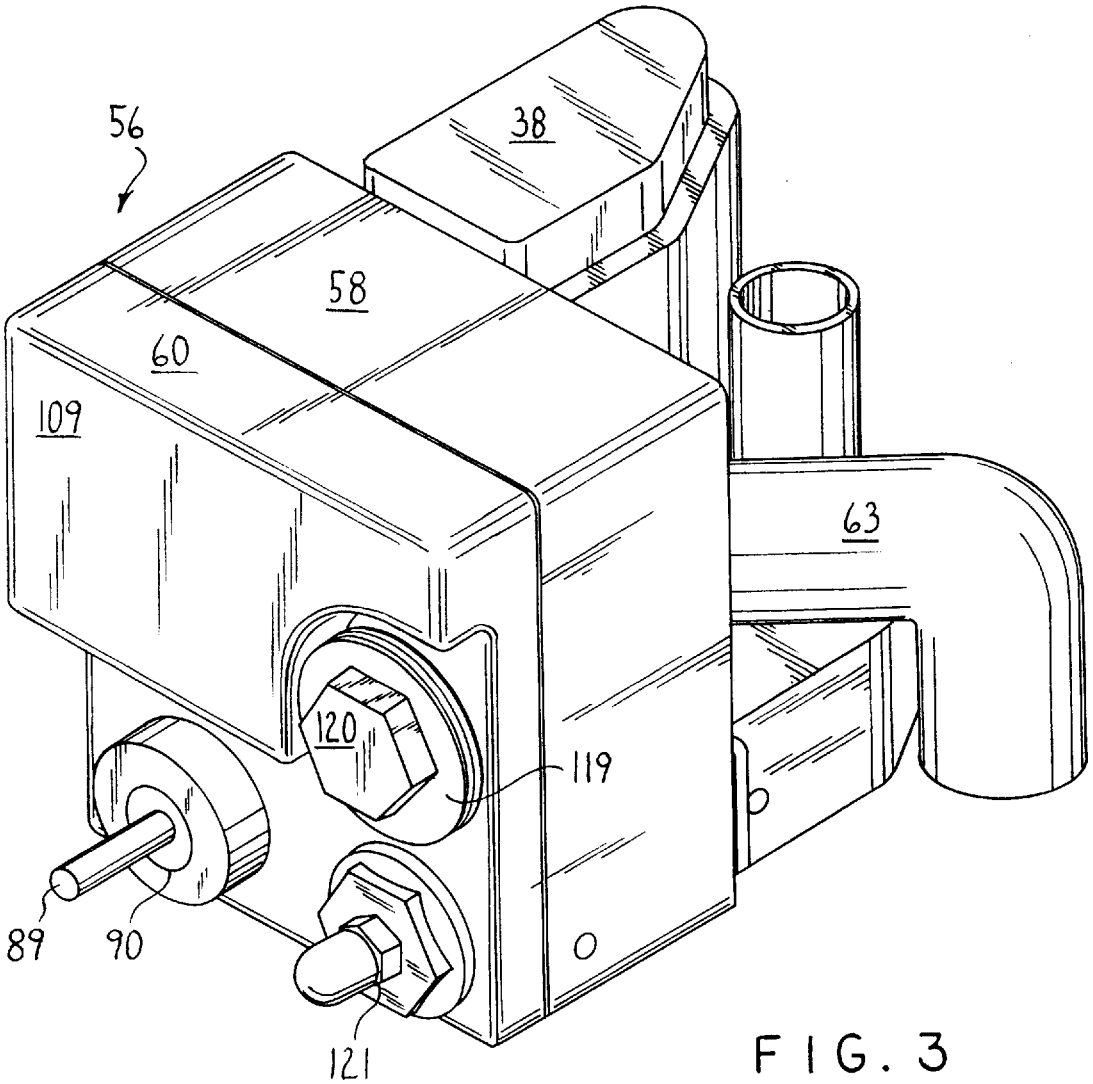
FIG. 3 is an isometric illustration of a pump casing of this invention.
Figure 4:
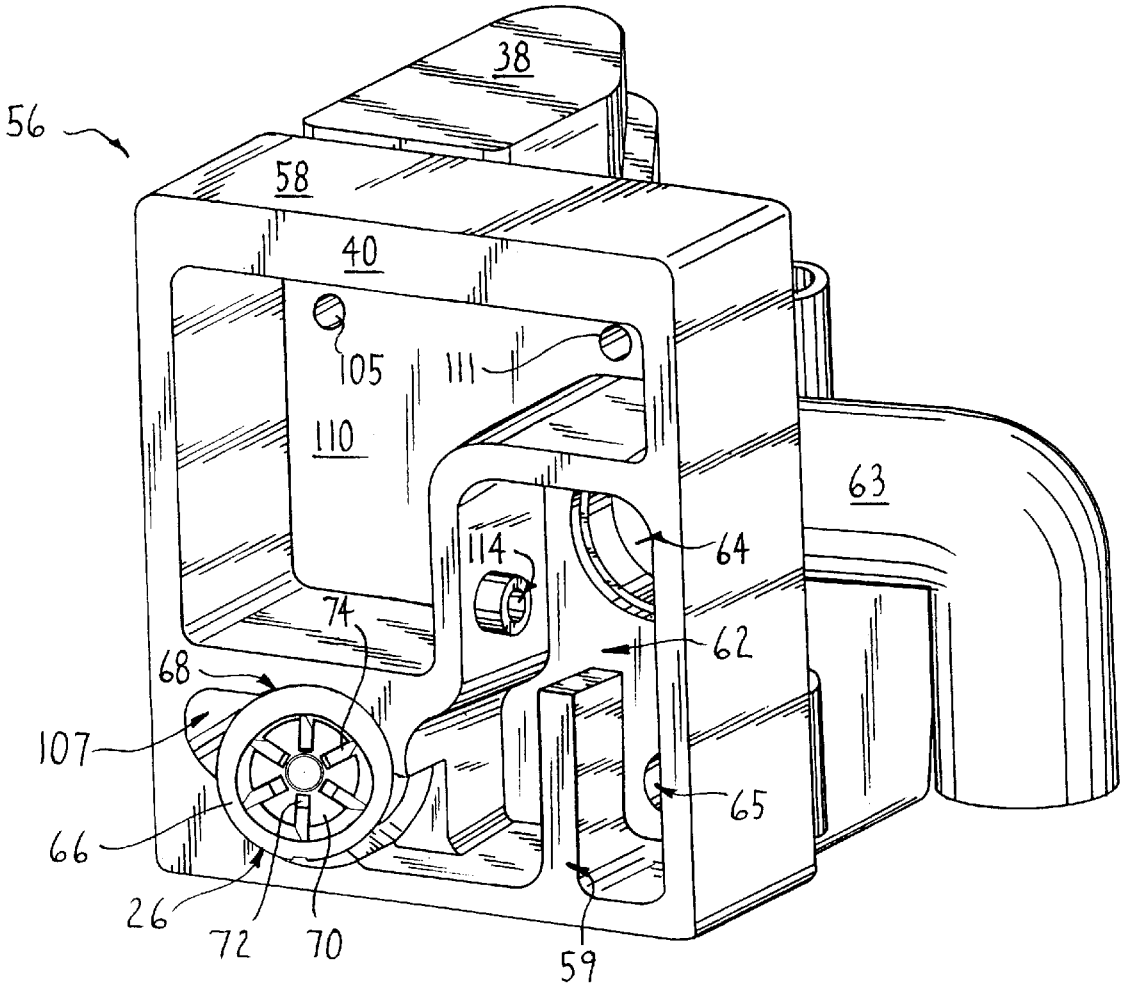
FIG. 4 is an isometric view of this inside of the pump casing of FIG. 3.

FIGS. 3 and 4 illustrate a pump assembly 56 of one embodiment of the dispensing system 20 of this invention. Pump assembly 56 includes a casing body 58 that defines portions of the pump 26 and the air eliminator 40. Casing body 58 is covered by a face plate 60. As seen best by reference to FIG. 4, casing body 58 is shaped to form a pump inlet chamber 62. The pump inlet chamber 62 is the space internal to the casing body 58 to which an extension 63 of the supply line 28 from the storage tank 22 is connected. Casing body 58 is formed with an opening 64 to allow fuel flow from supply line extension 63 into inlet chamber 62. While not illustrated, in many preferred versions of the invention a strainer is fitted over opening 64 to prevent contaminates from entering the inlet chamber 62 with the fuel. The inlet chamber 62 is provided to reduce the velocity of the fuel flowing into the pump 26. This reduction in velocity is desirable in order to keep the net positive suction head required of the pump 26 as low as possible.

Casing body 58 is also provided with a bypass opening 65 into the inlet chamber 62. Bypass opening 65 is provided so fuel from the air separator 38 can be returned to the pump 26. The bypass valve 52 (FIG. 2) is seated in the inlet chamber 62 so as to normally block fluid flow through bypass opening 65. A spring 67, (shown diagrammatically in FIG. 2) normally holds the bypass valve 52 closed.

It will be further be observed that in the illustrated version of the invention, bypass opening 65 is located towards the gravity-centered bottom of the inlet chamber 62. The pump casing is further formed with a wall 59 that extends upwardly from the base of the casing body 58 between the bypass opening 65 and the pump 26. During periods of time in which the bypass valve 52 is open, wall 59 causes the fuel flowing into the inlet chamber from the valve to flow upwardly prior to it flowing into the pump 26.

Pump 26 is located immediately above the base of the casing body 58 to create flooded suction at all times. The pump 26 includes a liner 66 that is seated inside a circular bore 68 defined by the internal walls of the casing body 58. A rotor 70 is seated in the center of liner 66. The rotor 70 is formed with slots 72 in which vanes 74 are seated. As best by reference to FIG. 4A, liner 66 is formed to define an eccentrically cammed pump chamber 76 in which the rotor 70 and vanes 74 are seated. By eccentrically cammed, it is understood that the liner 66 is shaped so that relative to the center axis of the liner, depicted by point 73, the pump chamber 76 has a non-circular profile.

Figure 4B:
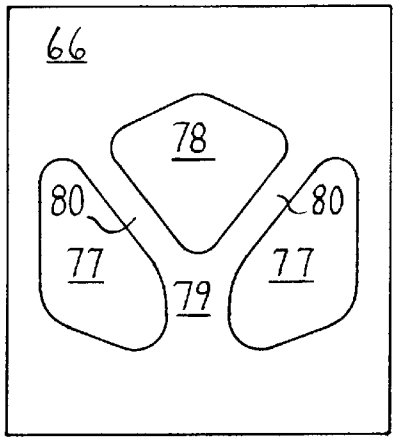
FIG. 4B is a side view of the inlet into the pump chamber.
Figure 4A:
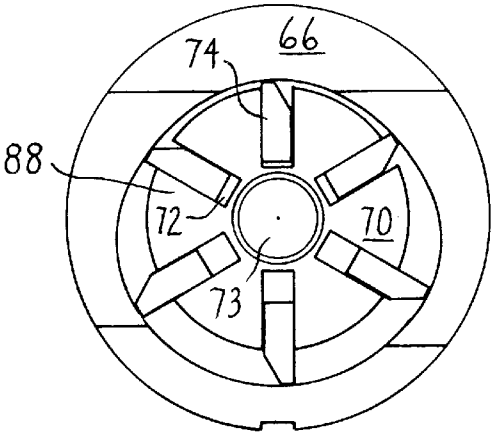
FIG. 4A is a plan view of the pump chamber.
Figure 4C:
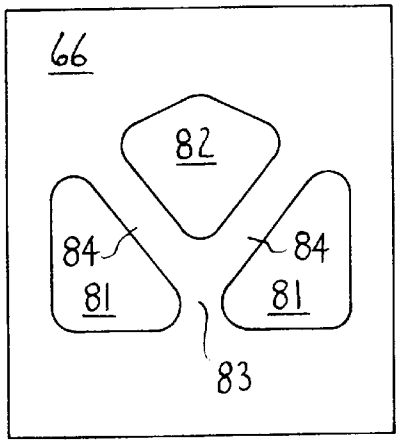
FIG. 4C is a side view of the outlet from the pump chamber.

FIG. 4B illustrates the symmetric top and bottom openings 77 and center opening 78 in the liner 66 that form the inlet into the pump chamber 76. Openings 77 and 78 are defined by a first, relatively wide web 79 from which two branch webs 80 symmetrically branch. FIG. 4C illustrates the symmetric top and bottom openings 81 and the center opening 82 in the liner 66 that from the outlet from the pump chamber 76. Openings 81 and 82 are formed by a first, central web 83 from which two additional webs 84 branch away. It will be observed that the inlet openings 77 and 78 are longer in width than the height of the complementary outlet openings 81 and 82, respectively. For example, in one version of the invention, openings 77 are at least 0.10 inches greater in width than openings 81 and opening 78 is 0.10 inches in greater in width than opening 82. The relatively large size of openings 77 and 78 reduce the fluid frictional losses of the fuel flowing into pump chamber 76.

Figure 5A:
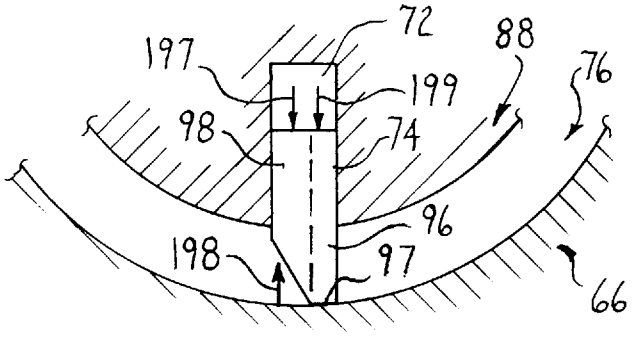
FIG. 5A is a side view illustrating the fluid forces acting on a vane during the operation of the dispensing system.
Figure 5:
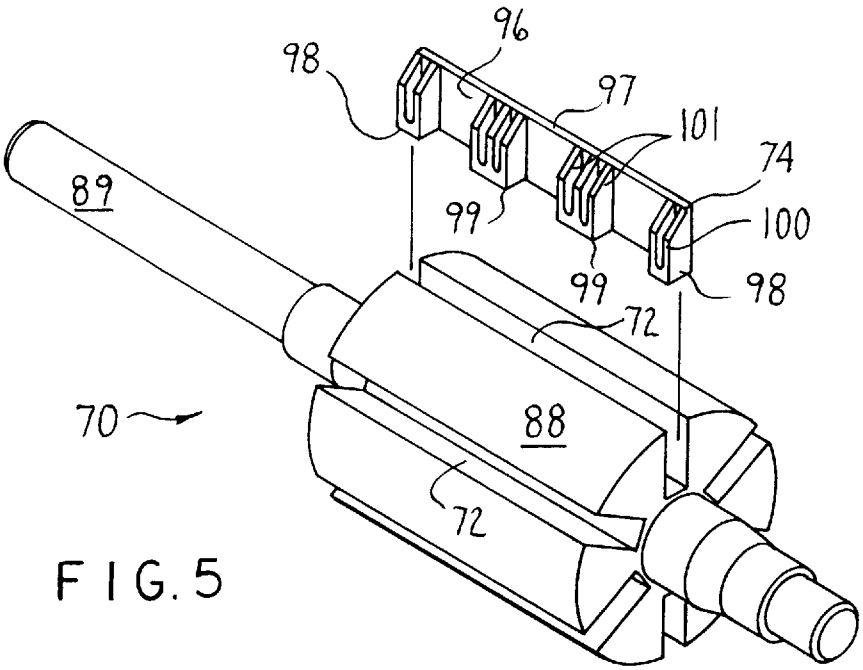
FIG. 5 is an exploded view of the pump rotor and a vane that are internal to the pump.

As seen best in FIG. 5, rotor 70 is shaped to have solid body 88. The body 88 is the portion of the rotor 70 seated in the pump chamber 76. In preferred versions of the invention, body 88 has an outside diameter of 2.0 inches or less, in more preferred versions of invention, the outside diameter is 1.6 inches or less and in the most preferred versions of the invention, the body has an outside diameter of 1.3 inches or less. The body 88 is the portion of rotor 70 formed with the slots 72 in which the vanes 74 are seated. In the illustrated version of the invention, body 88 is formed with six slots 72 that are spaced at 60° intervals.

Rotor 70 is further formed to have a reduced diameter shaft 89 that extends outwardly from the body 88. The 89 shaft extends through a bore 90 formed in the face plate 60 of the pump casing 56. The shaft 89 is coupled to a motor 91 (FIG. 2) that rotates the rotor 70. In preferred versions of the invention, the rotor is turned at a rate of 1500 RPM or higher. In more preferred versions of the invention, the motor 91 is rotated at speeds between 2500 and 3000 RPM. Still in other preferred versions of the invention, the rotor may be actuated at rates up to 3500 RPM or higher The actuation of rotor 70 at these speeds makes it possible for pump 26 to pump liquid-state fuel at rates between 40 and 150 l/min from the storage tank 22 and through the dispensing system 20. In more preferred versions of the invention, it is anticipated that pump 26 will pump fuel at rates between 50 and 100 l/min.

Each vane 72 is depicted to have a generally flat, rectangularly shaped body 96. The top edge of the body 96 forms a sealing surface 97 which is the surface of the vane that abuts the inside wall of the liner 66 that defines the pump chamber 76. The vane 72 is further provided with a set of ribs 98 and 99 that are integrally formed with the body 96 and that extend the length of the body. Ribs 98 are located at the opposed ends of the body and are relatively narrow in width. Ribs 99 are located around the center of the body 96 and are relatively wide. Each rib 98 is formed to define a single slot 100. Each rib 99 is formed to define two slots 101 that are parallel with each other. It should further be observed that the upper portions of the ribs 98 and 99 are formed with bevelled surfaces that meet the sealing surface 97 of the vane body 96.

Owing to the non-circular profile of pump chamber 36 and the centrifugal forces that act on vanes 74. Consequently, during the period one vane is fully retracted in the associated slot 72, the diametrically opposed vane is in its fully extended state. Fuel discharged from pump 26 flows through a discharge bore 107 formed in the casing body 58 to the air separator 38.

Pump casing 58 (FIG. 4) is further formed to contain the air eliminator 40. More particularly, the pump casing 58 is formed to define an air elimination chamber 110 that is located above the pump 26. The portion of the pump casing 58 that defines the air elimination chamber 110 is formed with a bore 105 through which the air and fuel vapors extracted from the fuel stream by the air separator 38 are supplied to chamber. (Not depicted is the fluid conduit leading from the air separator 38 to the air elimination chamber 110.) The air elimination chamber 110 serves as the space in which any small fuel droplets or fuel vapor entrained in the air stream from the air separator 38 are able to collect and condense into liquid-state fuel. The fuel-free air that remains in the top of the air elimination chamber 110 is vented from pump casing 56 through an opening 111 in casing body 58.

Returning to FIG. 2, it can be seen that it some versions of the invention that there may further be a conduit 113 extending from control actuator 48 to the air elimination chamber 110. (The opening in casing body 58 to which conduit 113 is connected is not illustrated.) This fluid communication may be required because, as described hereinafter, control actuator 48 can be a source of vapor laden air.

The liquid-state fuel that collects in the bottom of the air elimination chamber 110 is returned to the pump 26 through an opening 114 in one of the walls of the casing body 58 that places the air elimination chamber 110 in fluid communication with inlet chamber 62. Fluid flow through opening 114 is controlled by a float valve 115 represented diagrammatically in FIG. 2. In some preferred versions of the invention, float valve 115 has a valve member 116, shown as a block element, that selectively covers opening 114 to regulate fluid flow therethrough. The open/closed state of valve member 116 is regulated by a lever arm 117. The lever arm 117 is displaced by a float 118 connected to the end of the arm opposite the end to which the valve member 116 is connected. Only after the volume of liquid-state fuel in the air elimination chamber 110 reaches a certain level, does the float 118 become sufficiently buoyant to move the lever arm 117 so as to cause the subsequent displacement of valve member 116. The movement of the valve member 116 allows the liquid-state fuel to flow through opening 114 into the inlet chamber 62. As the volume of liquid-state fuel in the air elimination chamber 110 falls, the float 118 lowers and the valve member 116 is returned to its initial, closed state. Thus, float valve 115 allows fluid communication from the air elimination chamber 110 to the inlet chamber 62 only when there is liquid-state fuel in the lower portion of the air elimination chamber 110. This control thus prevents air from the air elimination chamber 110 from being entrained in the fuel stream flowing to the pump 26.

As depicted in FIG. 3, the face plate 60 of pump assembly 56 is formed to have an outwardly extending upper section 109. Upper section 109 defines a cavity on the inside of the face plate, (cavity not illustrated), that is contiguous with and forms a portion of the air elimination chamber 110. Below upper section 109, face plate 60 is provided with a cap 119. Cap 119 is opened to access to the strainer internal to inlet chamber 62. Cap 119 is provided with a shaped head 120 so that a wrench can be used to loosen/tighten the cap. Face plate 60 is also provided with a rotating stud 121. Stud 121 is attached to a set screw, (not illustrated,) that holds the tension on spring 67 that forms part of the bypass valve 52 (FIG. 2). This adjustment of this tension makes it possible to set the pressure at which the bypass valve 52 opens.

Figure 6:
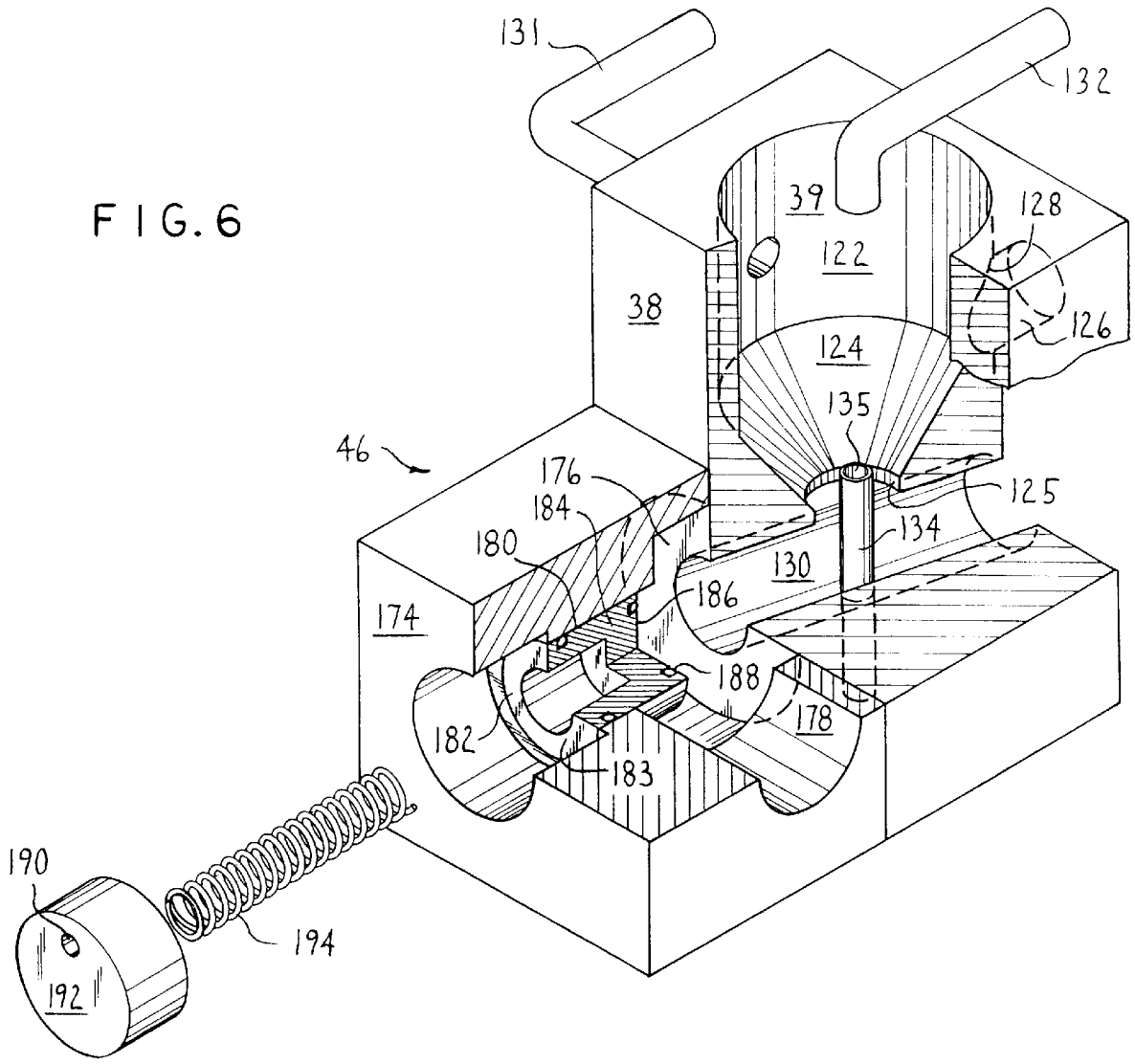
FIG. 6 is a partial cross sectional view of the air separator and fuel shutoff valve of this dispensing system.

The fuel stream discharged from pump 26 is applied to the air separator 38 which is now described by reference to FIG. 6. Air separator 38 is formed to define a two-section, vertically oriented air separation chamber 39. The first, upper section 122 of the air separation chamber 39 has a generally cylindrical shape. Contiguous with and extending downwardly from the upper section 122 is a second, lower section 124 that has a frusto-conical profile. The nadir, the base of the lower section 124, is in fluid communication with a constant diameter neck 125. In preferred versions of the invention, neck 125 has a height of between 0 and 1.0 inches.

The fuel stream from the pump 26 is discharged into the air separation upper section 122 through a duct 126 and an opening 128. It can be observed that duct 126 and opening 128 are shaped so that the fuel stream is discharged along a path that is tangential to the outer perimeter of the chamber 39. The discharge of fluid in this pattern ensures the fuel flows in a cyclonic pattern. The neck 125 of the air separation chamber 39 is in fluid connection with a horizontally aligned flow-through conduit 130. The air-free fuel stream from the air separation chamber 39 is discharged from the chamber into the flow-through conduit and, as described hereinafter, is directed toward the dispenser head 42 (FIG. 2). Air separator 38 is also provided with a bleed tube 134 that serves as the conduit through which the air and vaporized fuel are removed from the fuel stream. Bleed tube 134 is a vertically aligned tube that is positioned to have an opening 135 that is positioned immediately above the nadir of the air separation chamber lower section 124. The opening 135 is centered along the longitudinal axis of the air separation chamber 39. The tube 134 extends downwardly so extend through the center of the flow-through conduit 130. The pressure in air separation chamber 39 is greater than the ambient air pressure. Thus, air and vaporized fuel in air separation chamber 39 are forced into bleed tube 134 and, from the bleed tube, flow into the air elimination chamber 110.

Two measuring lines 131 and 132 are attached to air separator 38 so as to be in fluid communication with the upper section 122 of air separation chamber 39. Measuring line 131 is fitted to air separator 38 so as to be a conduit for a fluid column branched from the outer perimeter of the air separation chamber upper section 122. Measuring line 132 is fitted to air separator 38 so as to be a conduit from a fluid column branched from the center of the air separation chamber upper section 122. Both lines 131 and 132 are connected to control actuator 48 to present the control actuator with two pressure heads that, collectively, represent the differential pressure across the radius of the air separation chamber 39.

Figure 7A:
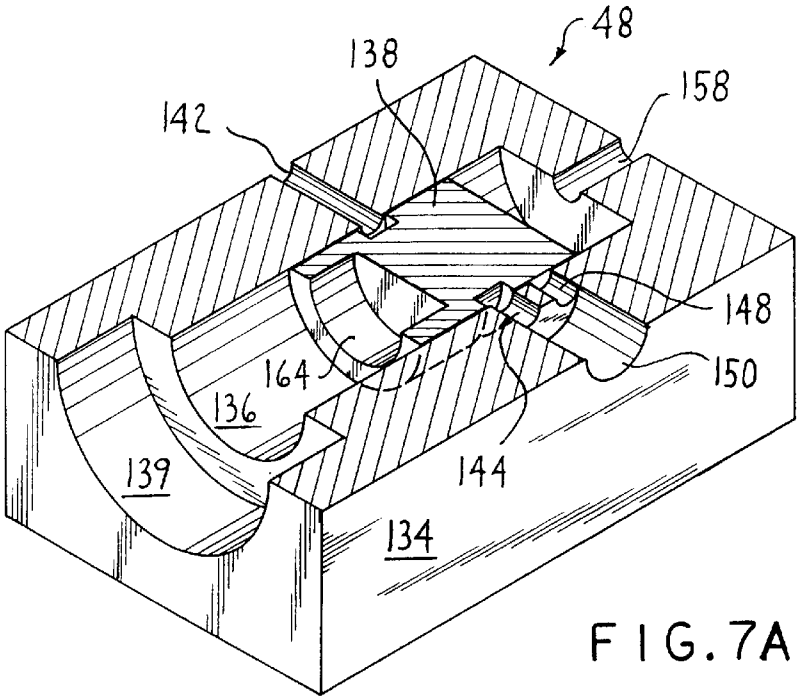
FIG. 7A is a cross sectional view of some of the components forming the control actuator illustrating the arrangement of the components when only nominal quantities of air are being drawn thorough the dispensing system.
Figure 7B:
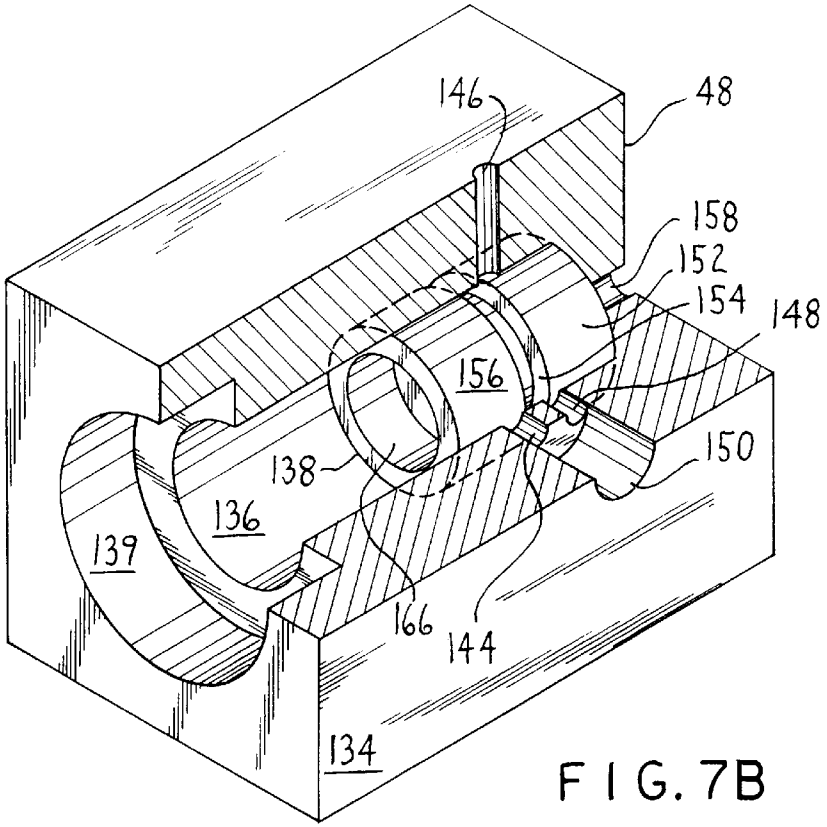
FIG. 7B is a cross sectional view of some of the components forming the control actuator illustrating the arrangement of the components when relatively large quantities of air are being drawing through the dispensing system.
Figure 8A:
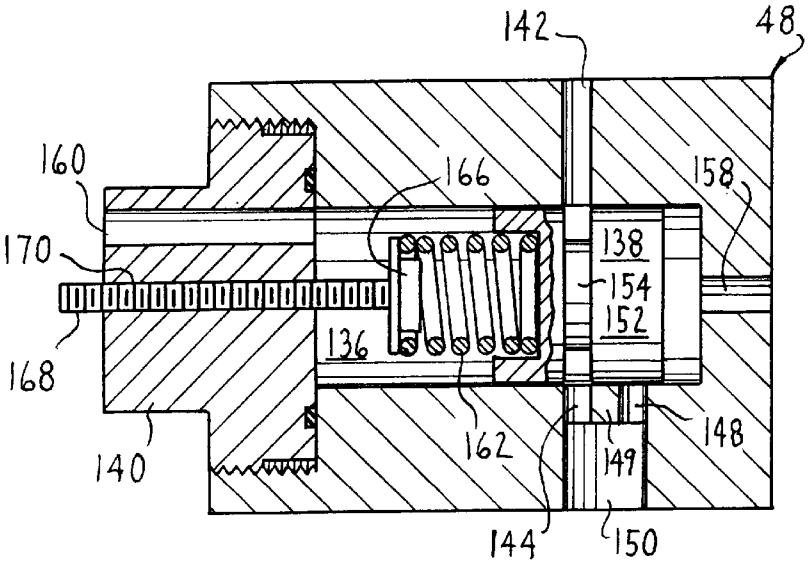
FIG. 8A is a second cross section view of the control actuator as depicted in FIG. 7A.

Control actuator 48, now described by reference to FIGS. 7A and 8A, includes a casing 134. Casing 134 is formed to have a enclosed, cylindrical valve chamber 136 in which a valve member 138 is housed. In the depicted version of the invention, one end of the casing 134 forms one of the closed ends of the valve chamber 136. The opposed end of the casing 134 is formed with a threaded counterbore 139. A cap 140 is secured in the counterbore so as to seal valve chamber 136. Casing 134 is formed with a first air inlet duct 142 that extends from the outside of the casing to valve chamber 136. Air inlet duct 142 is ported to the ambient environment through conduit 113 and air elimination chamber 110 (FIG. 2). Axially aligned with air inlet duct 142 and formed on the opposed side of casing 134 is an air outlet duct 144. Casing 134 is further formed with two diametrically opposed pressurized fluid ducts 146 (FIG. 7B, one shown). Pressurized fluid inlet ducts 146 extend from the opposed sides of the casing 134 to valve chamber 136. Branches of line 131 are connected to the pressurized fluid inlet ducts 146 to provide relatively high pressure fluid thereto. There is also a pressurized fluid outlet duct 148 that is in the same plane as the pressurized fluid inlet ducts 146 and is located adjacent and parallel to air outlet duct 144. Air outlet duct 144 and high pressure fluid outlet duct 148 are separated by a web 149. In the illustrated version of the invention, it can be seen that the casing 134 is further formed to have a control fluid outlet duct 150 that subtends the openings of air outlet duct 144 and high pressure fluid outlet duct 148.

Fluid flow through control actuator 48 is controlled by valve member 138. The valve member 138 has a generally cylindrical body. Generally, the body of the valve member 138 is dimensioned to have an outer diameter that is approximately 0.0005 to 0.004 inches less than the diameter of the wall of the casing 134 that defines valve chamber 136. In some preferred versions of the invention the body of the valve member is 0.002 inches in diameter less than that of the valve chamber 136. Valve member 138 is further formed to have a generally solid base 152. The base 152 is the portion of the valve member that is positioned proximal to the closed end of casing 134. Adjacent base 152 valve member 138 is formed to have a reduced diameter neck 154. Extending forward from neck 154, there is a head 156 (FIG. 7B) having the same diameter as base 152.

During operation of the dispensing system 20, owing to the close spacing between the valve member base 152 and the adjacent inner wall of the casing 134, a very stabile, nonturbulant boundary layer flow is established by the fluid introduced through ducts 146 around the base 152. The laminar profile of this flow prevents large quantities of the pressurized fluid from discharging through the high pressure fluid outlet duct 148. This fluid flow causes a capillary seal to form in the narrow circumferential interstitial space between the valve member base 152 and the adjacent inner wall of the casing 134. This seal prevents large quantities of the high pressure fluid from being discharged from the casing 134 through either the air inlet duct 142 or the air outlet duct 144.

It should, however, be recognized that small quantities of vapor-laden air may be discharged from the casing through the air inlet duct 142 during the operation of the dispensing system 20. This vapor flows through conduit 113 to the air elimination chamber 110. By directing the vapor to the air elimination chamber 110, the vapor is contained in a space in which it is able to coalesce and condense and then be returned into the inlet chamber 62 for eventual delivery as liquid-state fuel.

The position of the valve member 138 in the valve chamber 136 is a function of the difference in pressure between two fluid columns that are applied to the opposed ends of the valve chamber. The fluid column branched from the outer perimeter of the upper section 122 of the air separation chamber 39 is applied to the end of the valve chamber 136 proximal to the base 152 of the valve member 138. The fluid in this column is the fluid that flows through line 131. This fluid is applied to valve chamber 136 through a duct 158 formed in the closed end of casing 136. The fluid column that flows through line 132 is applied to the end of the valve chamber 136 proximal to the head 156 of the valve member 138. The fluid from line 132 is applied to valve chamber 136 through an opening 160 formed in cap 140.

Additional motive force for urging valve member 138 toward the closed end of casing 136 is provided by a spring 162 that extends between cap 140 and the valve member 138. The head section 154 of the valve member 138 is provided with a circular recess 164 in which spring 162 is seated. In the depicted version of the invention, the end of spring 162 proximal to cap 140 is fitted over a spring seat 166. The position of the spring seat 166 is controlled by an adjustment screw 168 that extends through a threaded bore 170 formed in cap 140. The position of the spring seat 166 is adjusted to set the biasing force spring 162 imposes on the valve member 138.

Returning to FIG. 6, it can be seen that in some preferred versions of the invention, fuel shutoff valve 46 is a fluid-set valve located immediately adjacent air separator 38 so as to abut one end of flow-through conduit 130. Fuel shutoff valve 46 includes a casing 174 that forms the body of the valve. Casing 174 is formed to have a valve chamber 176 that is in direct fluid communication with the adjacent end of the air separator flow-through conduit 130. It will be observed that valve chamber 176 has a diameter greater than that of the adjacent flow-through conduit 130. This relative dimensioning is to minimize the pressure drop across the fuel shutoff valve 46. An outlet duct 178 is formed in the casing 174 so as to extend from valve chamber 176 to the outside of the casing. In the illustrated version of the invention, outlet duct 178 extends perpendicularly relative to the longitudinal axis of the adjacent flow-through conduit 130. Fuel that is discharged from outlet duct 178 is directed through an appropriate conduit, (not illustrated), to dispenser head 42.

Fuel flow through the fuel shutoff valve 46 is controlled by a valve member 180. Valve member 180 has a base 182 that is seated in a valve bore 183 coaxial with valve chamber 176. The valve member 180 also has a head section 184 that selectively projects into the valve chamber 176. The head section 184 has a face 186 that is dimensioned to completely cover the open end of the flow-through conduit 130 that opens into the valve chamber 176. A first O-ring 188 seated in a groove formed in the face 186 of the valve member 180 forms a liquid-tight barrier between flow-through conduit 130 and valve chamber 176, (not identified). A second O-ring 190 is seated in a groove (not identified) formed around the outside of the base 182 of the valve member 180. O-ring 190 forms a liquid-tight barrier between the valve member 180 and the adjacent circumferential wall of the casing 174 that defines valve bore 183.

The open/closed state of fuel shutoff valve 46 is controlled by the pressure head of the two fluids applied to the opposed ends of valve member 180. The pressure head of the fuel flowing discharged from flow-through conduit 130 is applied to the face 186 of valve member 180 to urge valve 46 into the open state. The pressure head of the fluid column from control actuator 48 is applied to the opposed end of valve member 180 to urge valve 46 into the closed state. The fluid column from the control actuator 48 is routed into the valve bore 183 through a inlet 190 formed in a cap 192 that covers the open end of the valve bore. A spring 194 that extends between cap 192 and valve member 180 provides an additional biasing force to urge the valve member into the closed state.

When the dispensing system 20 of this invention is in use, the motor 91 connected to pump 26 is actuated to cause a suction force to develop in the pump chamber 76. The suction developed in the pump chamber 76 causes fuel to be drawn from the storage tank 22, through supply line 28 and into the inlet chamber 62 of casing body 58. Owing to the relatively large volume of the inlet chamber 62, once the fuel flows into this chamber, its velocity decreases. This drop in fuel velocity prior to it being drawn into the pump chamber 62 serves to minimize the net positive suction head required of pump 26.

As can be seen from FIG. 5A, when the pump is actuated, the centrifugal force acting on a vane 74 causes the vane to project out of the slot 72 in which the vane is seated. The fuel under pressure flows into the slot 72. As represented by arrows 197 and 198, the opposed ends of the ribs 98 and 99 integral with the vane are exposed to equal and opposite pressurized fluid head; these opposed forces cancel each other out. However, as represented by arrow 199, the bottom surface of the body 96 of the vane 74, the surface opposite sealing surface 97, is exposed to a pressurized fluid force that is not canceled out by any opposed force. Consequently, this fluid-generated force urges the vane 74 against the adjacent inner wall of the liner 66. This action facilitates formation of a relatively fluid tight seal between the vane 74 and liner 66 during the operation of the pump 26.

The fuel is discharged from the pump 26 into the air separation chamber 39 through discharge bore 107, duct 126 and opening 128. Owing to the tangential discharge of the fuel into the upper section 122 of the air separation chamber 39, the fuel develops a cyclonic flow pattern in the chamber. This cyclonic flow serves to cause the less dense, gaseous, components of the fuel stream, such as an air or vapor entrained in the stream, to flow towards the center of the chamber 39. When the fuel stream enters the lower section 124 of the chamber 39, the diameter of the cyclonic flow incrementally decreases. The reduction in this diameter further forces the less dense components of the fuel stream towards the center of the air separation chamber 39. Owing to the vertical alignment of the axis of the air separation chamber 39, the horizontal position of the center of the vortex flow is essential stagnate, even when the fraction of gaseous state fluid in the fuel stream varies. The bleed tube opening 135 is positioned along this axis and is dimensioned so that it is larger in diameter than the diameter of the cone of air that forms in the center of the vortex. (It being understood that this air cone, above bleed tube opening 135 may have an increasingly larger diameter). As a result of the cyclonic flow patterns of the fluid in the air separation chamber 39 and the high pressure in the air separation chamber 39 relative to the air elimination chamber 110, the air and fuel vapor in this air cone is forced through the bleed tube 134. Consequently, the fuel stream that flows from the nadir of the air separation chamber 39, around the bleed tube 134, through neck 125 and into flow-through conduit 130 is substantially free of any air that may have been previously entrained in the fuel stream.

Still another consequence of the development of the fuel flow through air separator 38 is that the fluid columns that appear in lines 131 and 132 that have unequal pressure heads. A fluid column having a high pressure develops in line 131, the line connected to the outer perimeter of the air separation chamber 39, in part because of the centrifugal force of the cyclonic fuel flow. Still another reason why this fluid column has a relatively high pressure is that as the neck 125 of the air separator 38 is a reduced diameter orifice. As the liquid-state fuel flows through this neck 125, an upstream backpressure develops in the liquid-state fuel in the air separation chamber 39. This backpressure further contributes to the increased pressure of the fluid column in line 131.

The fluid column in line 132, in contrast to the fluid column in line 131, has a relatively low pressure head. A first reason for this is that the fluid at the point this column is extracted from the air separator, the center axis of the air separator 38, does not have as much centrifugal force acting on it. Still another reason the fluid column in line 132 has a lower pressure head is that this point of fluid extraction is, through bleed tube 134 and air elimination chamber 110, more directly in fluid communication with the ambient environment. This fluid communication pathway thus further serves to hold the pressure of the center of the air separation chamber 39 down relative to the pressure present around the liquid-filled outer perimeter of the air separation chamber 39.

In normal situations, the quantity of air that may be in the fuel stream introduced into the air separation chamber 39 is initially relatively low. In these situations, the pressure head of the fluid column present in line 131 is at least between 4 and 20 psig higher than the pressure head of the fluid column present in line 132 and, more usually between 6 and 15 psig higher. Consequently, owing to the relative difference in these pressures, valve member 138 of control actuator 48 is urged toward the cap end of the valve casing as depicted in FIGS. 7A and 8A. When the control actuator 48 is in this state, the neck 154 of the valve member 138 is in the plane subtended by the axes of the air inlet duct 142 and air outlet duct 144. A flow-through path is established around neck 154 from the ambient environment to the control fluid outlet duct 150. Thus control actuator 48 applies an ambient air pressure head to fuel shutoff valve 46.

The ambient air fluid column from control actuator 48 is applied to the cap end of valve bore 183. This fluid column, even in combination with the force exerted by spring 194, is less than the pressure head of the fuel stream from flow-through conduit 130 that abut the face 186 of the valve member 180. Thus, the liquid fuel stream exerts enough pressure on valve member 180 to hold the valve member away from the opening of the flow-through conduit 130. Thus, the fuel shutoff valve is held in the open state so as to allow the essentially air-free fuel stream to flow to the dispenser head 42.

Immediately after the discharge of fuel from the nozzle 44 is terminated, there may be a period of time while the pump 26 remains actuated. When this occurs, the pressure head of the fluid in flow-through conduit 130 and the contiguous fluid conduit 50 will increase to a level sufficient to overcome the spring force holding bypass valve 52 closed. Thus, bypass valve 52 opens so as to allow cause the recirculation of fluid discharged from pump 26 back into inlet chamber 62. This recirculation of the fuel serves to reduce, if not eliminate, the draw of fuel from supply line 28 into the inlet chamber 62.

It will be recognized that the placement of wall 59 causes this returned fuel discharged through bypass opening 65 into the inlet chamber 62 to flow upwardly. The returned fuel thus flows into the space of the inlet chamber 62 into which the fuel is initially discharged from the supply line extension 63. Thus, the last quantity of fuel delivered to the inlet chamber 62 from supply line 28 is entrained into the fuel stream discharged by the bypass valve and forced through the pump 26 and then through air separator 38. This flow thus causes the fuel from the supply line 28 to be subjected to the air separation process. An advantage of drawing this portion of the fuel through the pump and then subjecting it the air separation processes is that it prevents the fuel from becoming stagnate in the inlet chamber 62. By preventing the fuel from stagnating in the inlet chamber 62, the likelihood that any air in this fuel could rise to the top of the inlet chamber 62 and form a bubble is kept to a minimum.

There may, however, be some circumstances in which a relatively large amount of air becomes entrained in the fuel stream. Such event can occur if there is a crack in the storage tank 22 or a leak forms in the supply line 28. If this occurs, the entrained air is forced through the pump 26 with the fuel. As the quantity of air in the fuel stream rises, the difference in pressure between the pressure heads in lines 131 and 132 falls. Once this differential pressure falls to below a set level, the pressure head of the fluid column from line 131 generates less force than that generated by spring 162 and the pressure head of the fluid column from line 132. In some preferred versions of the invention, this transition point is reached when the volumetric quantity of air reaches 10 to 20% of the total volume of the fluid drawn into the inlet chamber 62.

Figure 8B:
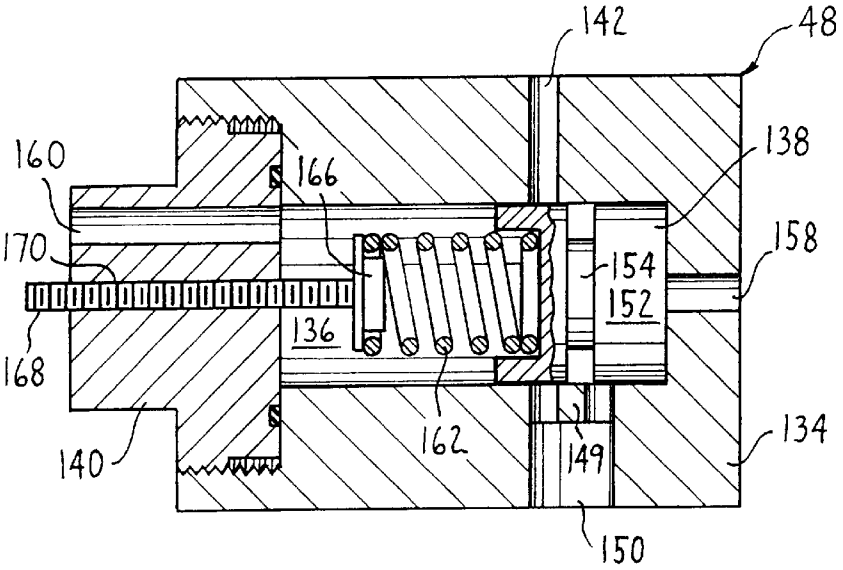
FIG. 8B is a second cross sectional view of the control actuator as depicted in FIG. 7B.

The simultaneous reduction in the pressure head of the fluid column in line 131 and rise in the pressure head of the fluid in line 132 results in the displacement of valve member 138. More particularly, as depicted by FIG. 8B, valve member 138 is displaced so that at least a portion of neck 154 subtends the section of the casing valve chamber 136 that is subtended by the pressurized fluid inlet ducts 146 and pressurized fluid outlet duct 148. Pressurized fluid thus flows from inlet ducts 146 around valve member neck 154, through outlet duct 148 and finally through fluid outlet duct 150.

Control actuator 48 thus applies a fluid column having a high pressure head to the cap end of bore 183 internal to the fuel shutoff valve 46. This pressure head is, in turn, applied to the base end 182 of valve member 180. The pressure head of the fuel stream discharged from the flow-through conduit and applied to the face 186 of the valve member 180 is less than that of pressure head of the column applied to the base. The reason for this difference is that pressure drop the fuel stream experiences as it flows through the neck 125 of the air separation chamber 39 causes the overall pressure of the fuel stream to drop in comparison to the pressure of this stream in the air separation chamber 39. Consequently, the force produced by the high pressure fluid column applied to the base 182 of the valve member 180, in combination with the force produced by spring 194, is greater than the force produced by the pressure head of the fuel that is discharged from flow-through conduit 130. Thus, the forces produced by the fluid column and spring 194 urge valve member 180 into the closed position, against the open end of the flow-through conduit 130. Fuel flow to the dispenser head 42 is thus blocked.

Once the fuel flow through fuel shutoff valve 46 ceases, the pressure of the fuel in flow-through conduit 130 and fluid conduit 50 increases. Eventually this pressure head increases to point where the fluid column in fluid conduit 50 has enough force to overcome the spring force that holds bypass valve 52 in its closed state. Bypass valve 52 then opens so as recirculate the fuel back to the inlet chamber 62 and pump 26. Thus, as long as the pump 26 is actuated and fuel shutoff valve 46 is closed, the fuel is not discharged from the dispenser unit 24 rather, the fuel is recirculated through the dispensing system 20. As described above, owing to the upward flow of the fuel recirculated into the inlet chamber 62, the chances of any air bubbles forming in the chamber is kept to a minimum.

FIG. 8B further illustrates that when there is a relatively high volumetric quantity of air in the fuel stream valve member 138 is positioned so that its neck 154 subtends both a section of the casing valve chamber 136 subtended by high pressure air outlet duct 148 and a section of the valve chamber subtended by the adjacent web 149. Consequently, should the quantity of the air in the fuel stream drop, the valve member 138 only has to traverse a relatively short distance, a distance less than the width of the web 149. Thus, once the quantity of air falls to acceptable level, the system 20 quickly return to its normal operating state for supplying fuel to the dispenser head 42.

It should, however, be recognized that the spring 162 is set so that the differential fluid force required to return valve member 138 to the normal position is slightly greater than the fluid force required to set the valve member 138 in the high-air flow state. For example, in a version of the invention wherein the valve member transitions to the high-air flow position when the quantity of air rises above 10% may be set to not transition back to the normal state until the quantity of air falls below 9.5%. This hysteresis setting of the control actuator 48 prevents the rapid toggling on and off of the dispensing system 20.

The dispensing system 20 of this invention thus serves as a convenient mechanism for drawing fuel from a storage tank 22 so that it can be delivered to a dispensing head 42 and, from their, discharged into a vehicle. The relatively small diameter of the rotor 70 in combination with the eccentrically formed pump chamber 76, make it possible for the pump 26 to supply large quantities of fuel to the dispensing head 42 even though the pump itself is relatively small in size. The small size of the pump 26 makes it possible to hold the overall relative size of the pump 26 and the pump assembly 56 to a minimum. This latter aspect of the invention facilitates the installation of the dispensing system 20 of this invention in compact above-ground dispenser units 24.

During most of the time the dispensing system 20 of this invention is in use, the air separator 38 removes any air and vaporized fuel that somehow becomes entrained in the fuel stream. This ensures that the fuel stream actually delivered to the dispenser head 42, the fuel stream that is subjected to charge metering, contains, for all intents and purposes, only fuel. In the event a large amount of air some how becomes entrained in the fuel stream, the differential pressure across the air separation chamber 39 will fall. This drop in differential pressure occurs even if the fluid column extracted from the air separation chamber through line 132 contains substantial amounts of vaporized fuel and fuel droplets instead of just air. The drop in this differential pressure causes the control actuator 48 to reset so that it directs a fluid column having a relatively high pressure head to fuel shutoff valve 46. Fuel shutoff valve 46, in turn, prevents the fuel stream with potentially unacceptable amounts of air from being applied to the dispenser head 42. Thus, the dispensing system 20 of this invention either removes air from the fuel stream that is metered to acceptable levels or, it prevents any fuel from being discharged.

Moreover, it should also be recognized that the bypass valve 52 may be open during the normal operation of the dispensing system 20 of this invention. This may be the case when the dispensing system generates a fluid flow having particular pressure in order to ensure that the fuel stream will be discharged from the nozzle 44 at a particular flow rate. Typically, components in the dispensing unit 24 downstream from the dispensing system 20 place restrictions on the flow of the fuel stream to ensure that the discharge is at a set maximum flow rate. These downstream restrictions may cause a backpressure to develop. Should this backpressure exceed the force holding bypass valve 52 closed, the valve will open. Thus, the bypass valve 52 will be open while the dispensing unit is delivering a normal fuel stream.

Furthermore, it is possible to employ this dispensing system 20 in dispensing units that have two or more nozzles 44 for delivering the same fuel. In these dispensing units, the fuel is discharged from the fuel shut-off valve 46 into a manifold. The fuel then flows from the manifold to different dispensing head-nozzle pairs. In these versions of the invention, pump 26 is capable of producing a fuel stream having a sufficient pressure to allow fuel streams simultaneously flowing through the individual nozzles to flow at a desirable discharge rate. When the dispensing system 20 is actuated to deliver fuel through less than all of the nozzles 44 at once, a backpressure may develop. In such circumstances, the bypass valve 52 opens. Thus, in these circumstances, a fraction of the fuel discharged from the air separator 28 will flow to the actuated nozzle(s) and a fraction of the fuel will be returned to inlet chamber 62.

Dispensing system 20 of this invention further operates to prevent air from being discharged from the nozzle 44 during priming. During priming of the dispensing system 20, the lines are initially filed with air. Pump 26 draws the air into the pump and discharges it into the air separation chamber 39. This initial fluid stream is forced into the bleed tube 134 and discharged into the air elimination chamber 110. When the pump 26 develops a sufficient vacuum, the liquid-state fluid is drawn from the storage tank 22 and discharged into the air separation chamber 39. The liquid-state fuel initially flows down the walls of the air separation chamber 39 and into the neck 125 around the bleed tube 134. The dense liquid forces the air remaining in the air separation chamber 39 towards the center of the chamber so as to force the air into the bleed tube 134. Eventually, sufficient liquid-state fuel flow is generated to cause a vortex flow pattern to develop. This feature is especially useful during a post-flood priming of the system 20. This post-flood priming is the priming that takes place after the initial priming of the system 20 when the downstream components such as the dispenser head 42 and flexible hose 32 are already full of liquid-state fuel. Post-flood priming is performed when, for whatever reason, the liquid-state fuel head from the storage tank 22 to the inlet chamber 62 is lost. In this post-priming state, the above-described process prevents any large bubble of compressed air that may form as a result of the priming process from inadvertently being released from the dispensing system 20 and then subsequently being discharged from the dispensing unit with the liquid-state fuel.

Moreover, if for any other reason a large quantity of air somehow becomes entrained in the fuel stream disrupts the cyclonic flow in the air separation chamber 39, the same process again forces any compressed air bubbles that develop in the air separation chamber 39 into the bleed tube 134. Thus, these air bubbles are again extracted from the fuel stream as opposed to being entrained in the flow downstream to the dispenser head 42.

It should be recognized that the foregoing description is for the purposes of illustration only. It will be readily observed that alternative constructions of the dispensing system 20 of this invention may be built. For example, there is no requirement that each version of the invention be provided with the specific eccentrically cammed pump that has been described. Also, in some versions of the invention it may be desirable to locate the air elimination chamber 110 in a casing separate from the casing housing the pump 26. With regard to the pump 26, still other versions of the invention may have different numbers of vanes than the described version and/or the vanes may have different constructions from what has been described.

Also, there is no requirement that bleed tube 134 always extend downwardly along the center axis of the air separation chamber 39. In some alternative versions of this invention, bleed tube opening 135 may be located along this axis and the tube 134 may extend away therefrom. In these versions of the invention, bleed tube 134 can be a diagonally oriented straight tube, a curved tube, a bent tube or have a combination of these profiles.

Moreover, in some versions of the invention it is contemplated that the bypass valve 52 may be set so that it will open when exposed most pressure heads applied thereto. For example, it may be desirable to configure the system 20 so that when pressurized air is primarily present in air separation chamber 39, as may happen during priming, the pressure head of the air flow-through conduit 130 will be sufficient to open up the bypass valve 52, but insufficient to open fuel shut-off valve 46. An advantage of this arrangement is that during the initial stages of priming, and at other times when substantially air-only fluid streams are discharged into the air separator 38, the air will be returned to the inlet chamber 62 as opposed to be allowed to flow downstream to the dispenser head 42.

It should also be recognized that only one version of the air separation chamber has been described. For example, while in most preferred versions of the invention the air separation chamber has a generally vertically oriented axis, it need not always have the two sections as described. It may, for example, be desirable to provide the air separator 38 so that it defines a chamber with a single, downwardly directed conic profile. Alternatively, the air separation chamber may have an inwardly curved profile. Likewise, the fuel shutoff valve and control actuator may have a different construction that has been described. For example, it may be preferable that in some versions of the invention the fluid columns containing the differential pressure heads act directly one a valve member integral with the fuel shutoff valve so as to control the open/closed state of the fuel shutoff valve. An advantage of these versions of the invention is that they would eliminate the need to provide a separate control actuator.

Figure 9:
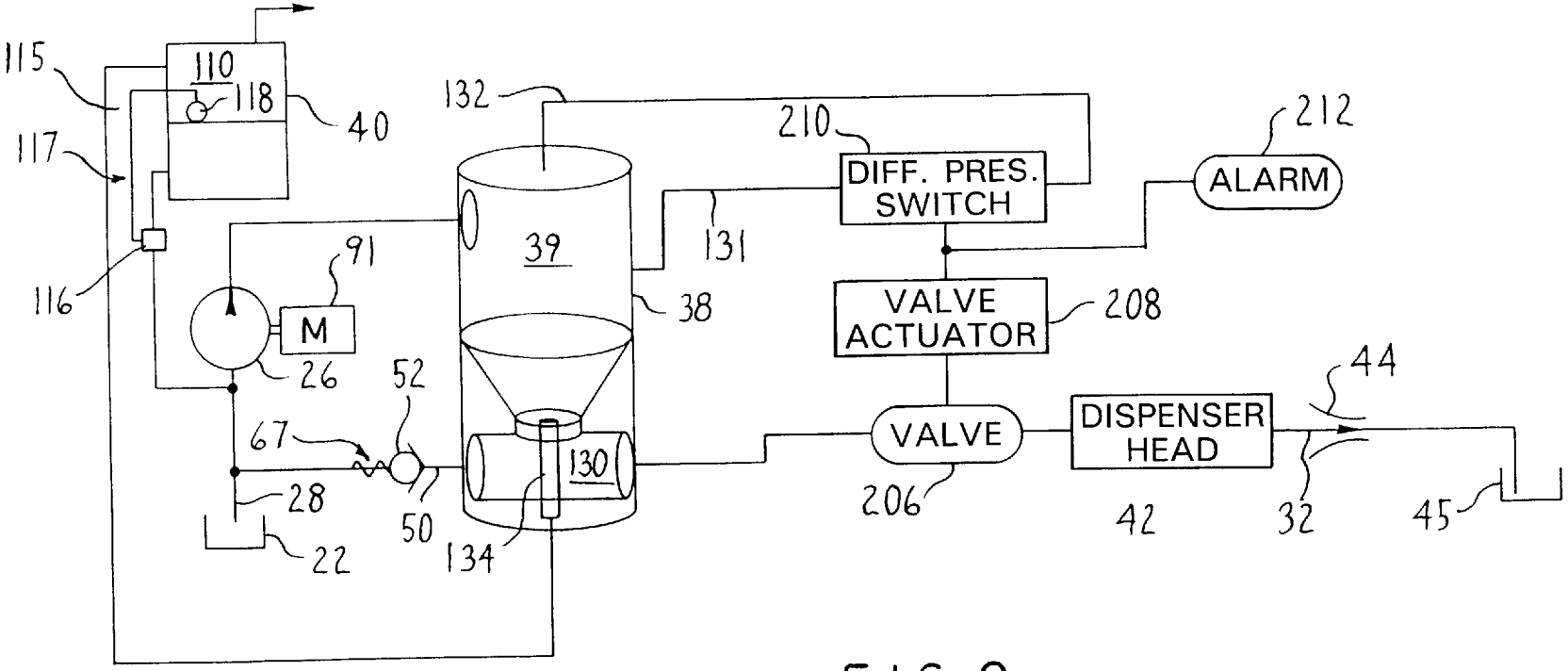
FIG. 9 is a block diagram illustrating the components of an alternative version of the dispensing system of this invention.

In still other versions of the invention, the fuel shut-off valve may be an electrically controlled valve 206, as seen in FIG. 9. In these versions of the invention, the pressure heads of the fluid columns drawn from the air separator 38 may act on transducers or pressure-actuated switches. These transducers or pressure-actuated switches, in turn, generate electrical signals that control an actuator 208 that regulates the open/closed state of the fuel shut-off valve 206. In some preferred embodiments, these fluid columns may be applied to a single differential-pressure actuated switch 210 that generates the signals that control the operation of the valve actuator 208. An advantage of these versions of the invention is that they eliminate the need to provide the control actuator. Also, the signals generated by the transducers or pressure actuated switch 210 can be used to trigger an alarm 212.

Therefore, it is the object of the appended claims to cover all such modifications and variations as come within the true spirit and scope of the invention.

The embodiments of the invention in which an exclusive property or privilege is claimed are defined as follows:

1. A dispensing system for drawing liquid-state fuel from a storage tank to a nozzle, said dispensing system including:

a suction pump connected to the storage tank for drawing fuel from the storage tank and producing a fuel stream;

an air separator connected to said suction pump for receiving the fuel stream, said air separator being configured to remove gaseous fluids from the fuel stream so as to produce an air-free fuel stream; and a fuel shutoff assembly connected to said air separator for receiving the fuel stream, to a first fluid column having a pressure head representative of the liquid-state fuel in the air separator and to a second fluid column having a pressure head representative of gaseous fluids in the air separator, wherein said fuel shutoff assembly selectively regulates the flow of the fuel stream to the nozzle based on the difference in pressure between the pressure head of the first fluid column and the pressure head of the second fluid column.

2. The dispensing system of claim 1, wherein:

the pressure head of the fluid in the first fluid column is greater than the pressure head of the fluid in the second fluid column;

said fuel shutoff assembly is configured to block the flow of the fuel stream to the nozzle when the difference between the pressure head of the first fluid column and the pressure head of the second fluid column drops below a first level; and said fuel shutoff assembly is configured to unblock the flow of the fuel stream to the nozzle when the difference between the pressure head of the second fluid column and the pressure head of second fluid column exceeds a second level that is greater than said first level.

3. The dispensing system of claim 1 wherein said fuel shutoff assembly includes:

a fuel shutoff valve having a casing connected to receive the fuel stream from the air separator and a valve member disposed in said casing for controlling fuel flow through said casing, said valve member being selectively opened and closed based on the application of a third fluid column with a variable pressure head thereto; and a control actuator connected to receive said first fluid column and said second fluid column from said air separator and a pressurized fluid and being configured to selectively apply the pressurized fluid to said valve member of said fuel shutoff valve as said third fluid column based on the difference in pressure between the pressure head of the first fluid column and the pressure head of the second fluid column.

4. The dispensing system of claim 3, wherein said control actuator selectively applies fluid from the first fluid column to said valve member of the fuel shutoff valve as the pressurized fluid.

5. The dispensing system of claim 3, wherein, when said control actuator does not apply pressurized fluid to said valve member of said fuel shutoff valve as the third fluid column, said control actuator applies ambient air to said valve member as the third fluid column.

6. The dispensing system of claim 1, wherein: said air separator defines an air separation chamber that has at least one section with a circular cross-section profile; the fuel stream from said suction pump is introduced into said air separator to form a cyclonic flow in said air separator chamber; the first fluid column is drawn from an outer perimeter location of said air separation chamber; and the second fluid column is drawn from a location of said air separation chamber axially inward to the location from which the first fluid column is drawn.

7. The dispensing system of claim 6, wherein: said air separator is constructed so that said air separation chamber is substantially vertically aligned; said air separator is formed so that at least a lower portion thereof has an inwardly directed profile; the fuel stream from the pump is discharged into an upper portion of said air separation chamber and the fuel stream is discharged through the lower portion of the of said air separation chamber; and a bleed tube extends into said lower portion of said air separation chamber so as to function as a conduit for the gaseous fluids removed from the fuel stream.

8. The dispensing system of claim 1, further including an air elimination chamber connected to said air separator for receiving the gaseous fluids removed from the fuel stream, said air elimination chamber including a conduit for supplying fluid to said suction pump and a control valve for controlling fluid flow through said conduit so as to allow only liquid-state fluid to flow through said conduit to said suction pump.

9. The dispensing system of claim 1, wherein:

said fuel shut-off assembly includes a fluid-set valve connected to receive the fuel stream discharged from said air separator, said fluid-set valve being set to open so as to allow fluid flow therethrough only when it is exposed to a minimum pressure head of the fuel stream discharged from said air separator.

10. The dispensing system of claim 9, further including a bypass line connecting said air separator with said suction pump for providing a return path for the fuel stream discharged from the air separator to said suction pump; and a bypass valve in said bypass line for regulating fluid flow through said bypass line, said bypass line being configured to open when the pressure head of the fuel stream discharged from the air separator exceeds a set pressure.

11. The dispensing system of claim 10, wherein said bypass valve is set to open when exposed to a pressure head less than the pressure head required to open said fluid-set valve.

12. The dispensing system of claim 1, further including a bypass line connecting said air separator with said suction pump for providing a return path for the fuel stream discharged from the air separator to said suction; and a bypass valve in said bypass line for regulating fluid flow through said bypass line, said bypass line being configured to open when the pressure head of the fuel stream discharged from the air separation chamber exceeds a set pressure.

13. The dispensing system of claim 1, wherein said fuel shutoff assembly includes:

an electrically controlled fuel shut-off valve located between said air separator and the nozzle for regulating fuel flow from said air separator to said nozzle; and a transducer assembly to which the first and second fluid columns from said air separator are applied, said transducer assembly configured to generate a signal to said fuel shut-off valve to control said fuel shut-off valve, wherein said transducer assembly selectively opens and closes said fuel-shut off valve based on the difference in pressure between the pressure head of the first fluid column and the pressure head of the second fluid column.

14. The dispensing system of claim 13, wherein said transducer assembly includes a single differential pressure-actuated switch to which both the first and second fluid columns are applied.

15. A dispensing system for drawing liquid-state fuel from a storage tank to a nozzle, said dispensing system including:

a suction pump connected to the storage tank for drawing fuel from the storage tank and producing a fuel stream;

an air separator connected to said suction pump for receiving the fuel stream, said air separator being formed to define an air separation chamber with a vertically aligned axis that has at least a lower section with an inwardly tapered profile, a top opening in an upper section through which the fuel stream from said suction pump is discharged into the air separation chamber, a bottom opening in said lower section through which an air-free fuel stream is discharged from said air separator to the nozzle and a bleed tube that extends upwardly into said bottom opening that has an opening in said lower section so that gaseous components of the fuel stream extracted in said air separation chamber are forced therethrough; and an air elimination chamber connected to said bleed tube, said air elimination chamber having a first port in fluid communication with the ambient environment, a conduit in fluid connection with said suction pump and a control valve for controlling fluid flow through said conduit so as to allow only liquid-state fluid to flow through said conduit to said suction pump.

16. The dispensing system of claim 15, wherein said suction pump and said air elimination chamber are contained in a single casing.

17. The dispensing system of claim 15, further including a fuel shutoff assembly located between said air separator and the nozzle for control of the flow of the fuel stream from the air separator to the nozzle, wherein said fuel shutoff assembly is further connected to said air separation chamber for receiving a first fluid column of fuel therefrom and said fuel shutoff assembly regulates the flow of the fuel stream to the nozzle as a function of the pressure head of the first fluid column.

18. The dispensing system of claim 17, wherein:

said air separator is formed from a casing that is shaped to define said air separation chamber and a flow-through conduit located below the air separation chamber for receiving the fuel stream discharged by the air separation chamber; and said fuel shutoff assembly includes a fluid-set valve that is located adjacent said casing of said air separator for receiving the fuel stream from the flow-through conduit, said fluid-set valve having a valve member that is selectively opened in response to a pressure head of the fuel stream discharged from said flow-through conduit.

19. The dispensing system of claim 17, wherein said fuel shutoff assembly is further connected to said air separation chamber for receiving a second fluid column of fuel therefrom and said fuel shutoff assembly regulates the flow of the fuel stream to the nozzle as function of the difference between the pressure head of the first fluid column and the pressure head of the second fluid column.

20. The dispensing system of claim 19, wherein said fuel shutoff assembly includes:

an electrically controlled fuel shut-off valve located between said air separator and the nozzle for regulating fuel flow from said air separator to said nozzle; and a transducer assembly to which the first and second fluid columns from said air separator are applied, said transducer assembly configured to generate a signal to said fuel shut-off valve to control said fuel shut-off valve, wherein said transducer assembly selectively opens and closes said fuel-shut off valve based on the difference in pressure between the pressure head of the first fluid column and the pressure head of the second fluid column.

21. A dispensing system for drawing liquid-state fuel from a storage tank to a nozzle, said dispensing system including:

a suction pump connected to the storage tank for drawing fuel from the storage tank and producing a fuel stream, said suction pump having:

a member shaped to define a pump chamber in fluid communication with the storage tank that has a center axis that is eccentrically cammed relative to the center axis;

rotor disposed in said pump chamber for rotation therein; said rotor having a plurality of slots that extend along the length of said rotor, said rotor having axis and being fitted into said pump chamber so that the axis of said rotor is offset from the axis of said pump chamber;

a plurality of vanes, each said vane being disposed in a separate one of said slots of said rotor; and a motor connected to said rotor for rotating said rotor at a rate of at least 2500 RPM;

an air separator having an air separation chamber in fluid communication with said pump chamber for receiving fuel discharged from said pump, said air separation chamber being configured to remove gaseous components from the fuel stream so as to produce an air-free fuel stream;

a fuel shutoff assembly connected between said air separation chamber and the nozzle for controlling flow of the fuel stream to the nozzle and being connected to said air separation chamber for receiving a first fluid column therefrom, said fuel shutoff assembly being configured to regulate the flow of the fuel stream to the nozzle as a function of a pressure head of the first fluid column; and an air elimination chamber connected in fluid communication with said air separation chamber for receiving the gaseous components removed in the air separation chamber from the fuel stream, said air elimination chamber having: a port which is vented to an ambient environment; a conduit connected to said inlet of said pump chamber; and a valve that controls fluid flow through said conduit so that only liquid-state fluid flows from said air elimination chamber through said conduit.

22. The dispensing system of claim 21, wherein each said vane of said pump includes an elongated body that defines a sealing surface that abuts an inner wall of said member that defines said pump chamber and at least two ribs integral with said body that are located at spaced apart locations, where said ribs have upper surfaces that are spaced away from said sealing surface.

23. The dispensing system of claim 21, wherein said valve assembly of said air elimination chamber includes a valve member for regulating fluid flow through said conduit to said inlet of said pump chamber and a float disposed in said air elimination chamber that is connected to said valve member for controlling the open/closed state of said valve member based on the volume of liquid-state fuel in said air elimination chamber.

24. The dispensing system of claim 21, wherein: said suction pump and said air elimination chamber are contained within a single pump casing, said pump casing being formed to define an inlet chamber for receiving fuel from the storage tank, said suction pump having an opening to draw fuel thereinto from said inlet chamber, and said conduit extending from said air elimination chamber is connected to said inlet chamber so that the liquid-state fuel in said air elimination chamber flows into said inlet chamber prior to being drawn into said suction pump.

25. A dispensing system for drawing liquid-state fuel from a storage tank to a nozzle, said dispensing system including:

a pump unit, said pump unit having:

a casing, said casing being shaped to define an inlet chamber for receiving fuel from the storage tank, an air elimination chamber having a port vented to the ambient environment, and a conduit for allowing fluid communication from said air elimination chamber to said inlet chamber;

a suction pump disposed in said pump unit casing, said suction pump having an inlet for drawing fuel from said inlet chamber; and a flow-valve in said conduit between said air elimination chamber and said inlet chamber for controlling fluid flow through said conduit so that only liquid-state fluid flows through said conduit;

an air separator having an air separation chamber in fluid communication with said pump chamber for receiving fuel discharged from said suction pump, said air separation chamber being configured to remove gaseous components from the fuel stream so as to produce an air-free fuel stream, said air separator having a bleed conduit connected to said air elimination chamber through which gaseous fluid components removed from the fuel stream are forced from air separation chamber into said air elimination chamber;

a fuel shutoff assembly connected between said air separation chamber and the nozzle for controlling flow of the fuel stream to the nozzle and being connected to said air separation chamber for receiving a first fluid column therefrom, said fuel shutoff assembly being configured to regulate the flow of the fuel stream to the nozzle as a function of a pressure head of the first fluid column;

a bypass line connected between said air separation chamber and the inlet chamber for provide a conduit for fuel stream discharged from the air separation chamber to flow into said inlet chamber; and a bypass valve for regulating fuel flow from said bypass line into said inlet chamber, said bypass valve being configured to open when a pressure head of the fuel stream discharged from said air separation chamber exceeds a set pressure.

26. The dispensing system of claim 25, wherein said flow-valve includes a valve member for regulating fluid flow through said conduit to said inlet chamber and a float disposed in said air elimination chamber that is connected to said valve member for controlling the open/closed state of said valve member based on the volume of liquid-state fuel in said air elimination chamber.

27. The dispensing system of claim 25, wherein said bypass valve is at least partially located in said inlet chamber.

28. The dispensing system of claim 25, wherein:

said fuel shut-off assembly includes a fluid-set valve connected to receive the fuel stream discharged from said air separator, said fluid-set valve being set to open so as to allow fluid flow therethrough only when it is exposed to a set minimum pressure head of the fuel stream discharged from said air separator; and said bypass valve is set to open when exposed to a pressure head less than the pressure head required to open said fluid-set valve.

29. A pump assembly said pump assembly including:

a pump casing, said pump casing having a base member that, is the lowest portion of said pump casing, said pump casing being shaped to form an inlet chamber that extends upwards from the base member; a main opening that extends into said inlet chamber through which fuel from a storage tank is drawn into the inlet chamber; a bypass opening into said inlet chamber for receiving a return fuel stream, said bypass opening being located below said main opening; and a discharge opening;

a suction pump disposed in a lower section of said pump casing so as to be located below said main opening into said inlet chamber, said suction pump having an inlet opening in fluid communication with said inlet chamber through which fuel is drawn into said suction pump and an outlet opening in fluid communication with said discharge opening through which fuel is discharged from said suction pump; and a wall integral with said pump casing that extends upwardly from said base member into said inlet chamber so as to be located between said bypass opening and said inlet opening of said suction pump.

30. The pump assembly of claim 29, further including a bypass valve disposed in said inlet chamber for regulating fuel flow into said inlet chamber through said bypass opening.

31. The pump assembly of claim 30, wherein:

said pump casing is further formed to have a bore located above said base member that is in fluid communication with said inlet chamber and said discharge opening; and said suction pump includes: a liner that is located in said bore formed in said pump casing, said liner being shaped to define an eccentrically profiled pump chamber, said inlet opening such that said inlet opening allows fluid communication from said inlet chamber to said pump chamber and said outlet opening so as to allow fluid communication from said pump chamber to said discharge opening; and a rotor disposed in said pump chamber.

32. The pump assembly of claim 29, wherein:

said pump casing is further formed to have an air elimination chamber separate from said inlet chamber, said air elimination chamber including an inlet for receiving fluid and an outlet port open to the ambient environment;

a conduit is positioned in said pump casing to allow fluid communication from said air elimination chamber to said inlet chamber; and a flow-valve is disposed in said conduit for controlling flow through said conduit so that only liquid-state fluid flows through said conduit.

33. The pump assembly of claim 32, wherein said flow-valve includes a valve member for regulating fluid flow through said conduit to said inlet chamber and a float disposed in said air elimination chamber that is connected to said valve member for controlling the open/closed state of said valve member based on the volume of liquid-state fuel in said air elimination chamber.

* * * * *